US007534963B1

(12) United States Patent
Martin et al.

(10) Patent No.: US 7,534,963 B1
(45) Date of Patent: May 19, 2009

(54) LOW-PROFILE CABLE

(75) Inventors: Ralph Sykes Martin, Mount Airy, NC (US); Joseph Edward Geniac, Greensboro, NC (US); Richard Speer, Kernersville, NC (US); Michael Thomas Gromko, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/972,430

(22) Filed: Jan. 10, 2008

(51) Int. Cl.
*H01B 11/02* (2006.01)

(52) U.S. Cl. ..... 174/113 R; 174/117 F

(58) Field of Classification Search ..... 174/113 R, 174/117 FF, 113 AS, 117 F
See application file for complete search history.

(56) References Cited

U.S. PATENT DOCUMENTS

| | | | | |
|---|---|---|---|---|
| 2,927,952 | A * | 3/1960 | Wermine | 174/27 |
| 4,419,538 | A | 12/1983 | Hansell, III | |
| 4,680,423 | A | 7/1987 | Bennett et al. | |
| 4,777,325 | A | 10/1988 | Siwinski | |
| 5,399,813 | A | 3/1995 | McNeill et al. | |
| 5,668,912 | A | 9/1997 | Keller | |
| 6,566,607 | B1 * | 5/2003 | Walling | 174/113 R |
| 2002/0053460 | A1 | 5/2002 | Takeda et al. | |

FOREIGN PATENT DOCUMENTS

| | | | |
|---|---|---|---|
| EP | GB 2275127 | * | 8/1994 |
| WO | WO 2005/045296 | | 5/2005 |

OTHER PUBLICATIONS

GB Search Report; Application No: GB0900237.9; Date of search: Jan. 23, 2009.

* cited by examiner

*Primary Examiner*—Chau N Nguyen

(57) ABSTRACT

A low-profile cable is provided and includes a body having upper and lower portions that extend a length of the body and also having opposite sidewalls joining the upper and lower portions to one another. The cable also includes passages that are located between the sidewalls. The passages extend the length of the body and are configured to receive at least one twisted pair of conductors. Also, the cable includes a load-bearing structural section that spans between the upper and lower portions. The structural section includes opposing wall supports separated by a pocket channel therebetween. The structural section is configured to support the upper and lower portions and substantially resist deformation of the passages when external forces are induced onto at least one of the upper and lower portions.

20 Claims, 4 Drawing Sheets

LOW-PROFILE CABLE

BACKGROUND OF THE INVENTION

The invention relates generally to electrical cables for transmitting signals, and more particularly to low-profile electrical cables that are subjected to compressive forces.

In some network or telecommunication systems, electrical cables or wires must travel underneath carpeting or some other type of flooring. In these instances, a low-profile cable may be used. The low-profile cable generally includes an elongated rectangular body having a plurality of passages extending lengthwise therethrough. The passages are configured to hold one or more electrical conductors. While underneath the carpet or flooring, the cable may be subjected to external forces, such as from people walking over the cable and/or equipment rolling or resting over the cable. These compressive forces may move and/or damage the electrical conductors within the corresponding passages. Furthermore, if the electrical conductors form twisted pairs, the twisted relationship of the conductors may be altered or disrupted thereby affecting the performance of the cable.

In one conventional low-profile cable, the cable includes an elongated rectangular body having upper and lower portions joined together by two sidewalls. The body also has two rectangular passages extending therethrough along the length of the body. The two rectangular passages are separated by an internal structural section that also joins the upper and lower portions of the body. Each rectangular passage has a width that is sized to hold two twisted pairs of conductors side-by-side. The structural section facilitates resisting the external forces that may be induced on the upper and/or lower portions. However, if the external forces are focused onto an area over one of the rectangular passages, the body may flex (or cave) into the passage thereby crushing, moving, and/or damaging the corresponding twisted pair of conductors.

In another conventional low-profile cable, the cable includes an elongated rectangular body that forms a large chamber extending lengthwise through the body. The chamber is surrounded and defined by upper and lower portions, which are joined together by two opposing sidewalls. The upper and lower portions each include a plurality of ribs that protrude from the corresponding portion into the chamber. Each upper portion rib is aligned with a corresponding lower portion rib thereby forming a constriction within the chamber. The constrictions prevent movement of the twisted pairs of conductors within the chamber. However, the constrictions provide little support for resisting compressive forces that may be applied to the cable. Thus, the positions of the conductors within each twisted pair may be altered with respect to the each other.

Moreover, as the market demand for smaller, faster electrical systems increases, the electrical systems must account for the increase in electromagnetic interference (EMI) and, in particular, the crosstalk that may occur between adjacent conductors or adjacent twisted pairs of conductors.

Thus, there is a need for a low-profile cable that is configured to resist compressive forces that may crush, move, and/or damage electrical conductors traveling through the cable. Also, there is a need for a low-profile cable that prevents the electrical conductors from moving with respect to each other.

Moreover, there is a need for low-profile cables that accomplish at least one of the above and reduce or avoid the harmful effects of crosstalk.

BRIEF DESCRIPTION OF THE INVENTION

In one embodiment, a low-profile cable is provided and includes a body having upper and lower portions that extend a length of the body and also having opposite sidewalls joining the upper and lower portions to one another. The cable also includes passages that are located between the sidewalls. The passages extend the length of the body and are configured to receive at least one twisted pair of conductors. Also, the cable includes a load-bearing structural section that spans between the upper and lower portions. The structural section includes opposing wall supports separated by a pocket channel therebetween. The structural section is configured to support the upper and lower portions and substantially resist deformation of the passages when external forces are induced onto at least one of the upper and lower portions.

Optionally, the pocket channel includes an air gap that has a width. Also, the two passages may form a spacing therebetween and the spacing and the width of the air gap may be configured to reduce and/or control the electrical coupling between the twisted pairs of conductors.

In another embodiment, a low-profile cable is provided and includes a body having upper and lower portions that extend a length of the body and also having opposite sidewalls that join the upper and lower portions to one another. The cable also includes passages located between the sidewalls. The passages extend the length of the body. The cable further includes a load-bearing structural section that spans between the upper and lower portions. The passages are configured to receive only a single twisted pair of conductors. The structural section is configured to support the upper and lower portions and substantially resist deformation of the passages when external forces are induced onto at least one of the upper and lower portions.

DETAILED DESCRIPTION OF THE INVENTION

Figure 1:
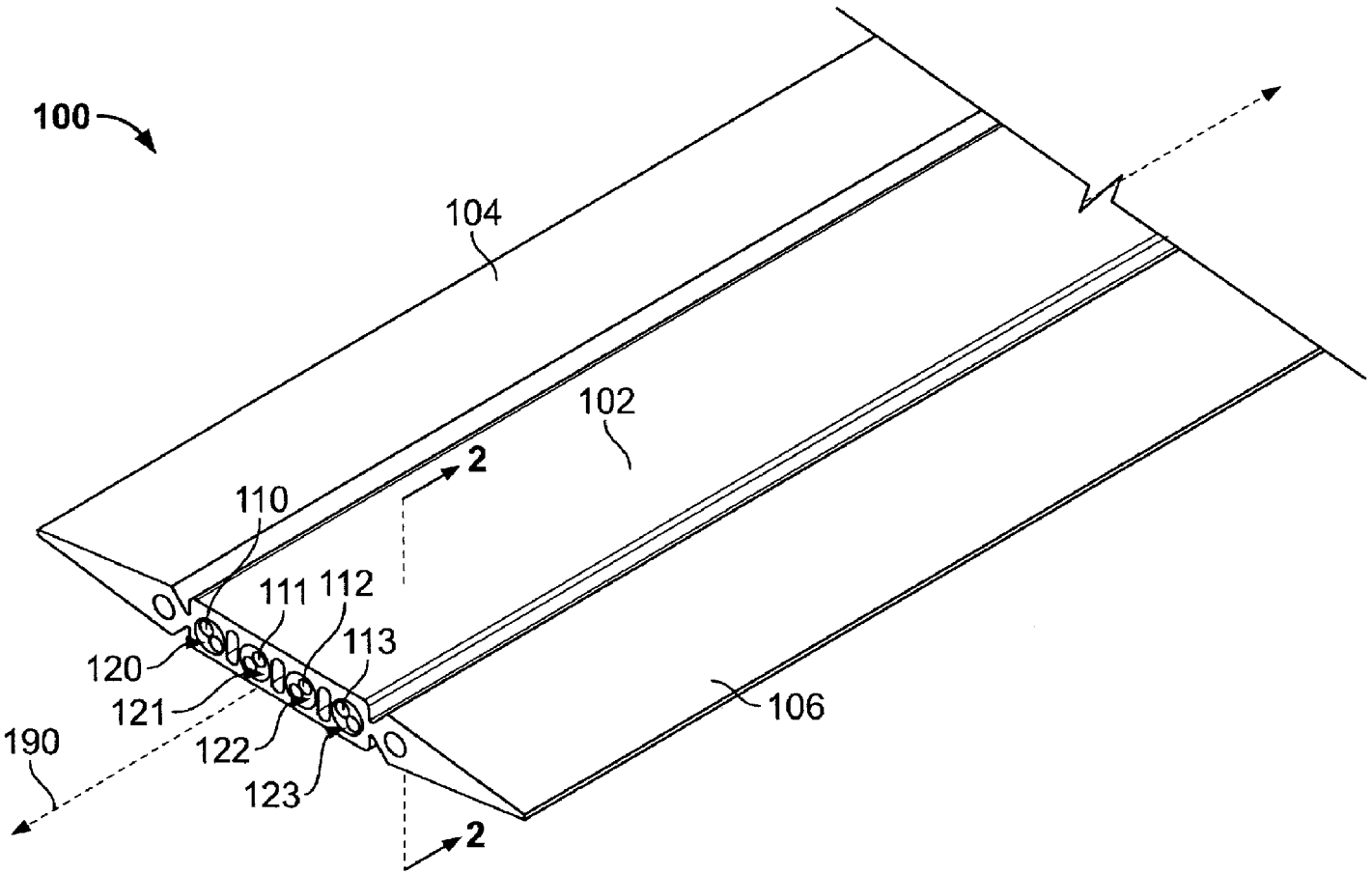
FIG. 1 is a perspective view of a low-profile cable formed in accordance with one embodiment.

FIG. 1 is a perspective view of a low-profile cable 100 formed in accordance with one embodiment. The cable 100 may be integrally formed from a dielectric material, such as polyvinyl chloride (PVC), during an extrusion process. The cable 100 may also be formed to include an elongated body 102 having a substantially rectangular cross section that extends lengthwise along a longitudinal axis 190. Alternatively, the body 102 may have other cross-sectional shapes, such as a rounded top or a substantially semi-circle shape. The body 102 includes a plurality of conductor passages 120-123 that are each configured to hole one or more conductors, which are illustrated in FIG. 1 as twisted pairs of conductors 110-113, respectively. Also, the cable 100 may include wing members 104 and 106 that project laterally outward from the body 102. The cable 100 shown in FIG. 1 may be used to transmit high speed electronic signals in a computer network, e.g., Ethernet, in areas or locations that require a low-profile cable, such as under carpeting or other flooring. However, the cable 100 may be used for other applications. As will be discussed in more detail below, the cable 100 may be configured to reduce or control the effects of electromagnetic interference (EMI) caused by adjacent conductors or adjacent twisted pairs of conductors. More specifically, the cable 100 facilitates resisting external forces that might alter the positions of the conductors and maintaining the positions of each twisted pair of conductors with respect to other twisted pairs of conductors by utilizing gaps within the dielectric material between adjacent twisted pairs of conductors.

Figure 2:
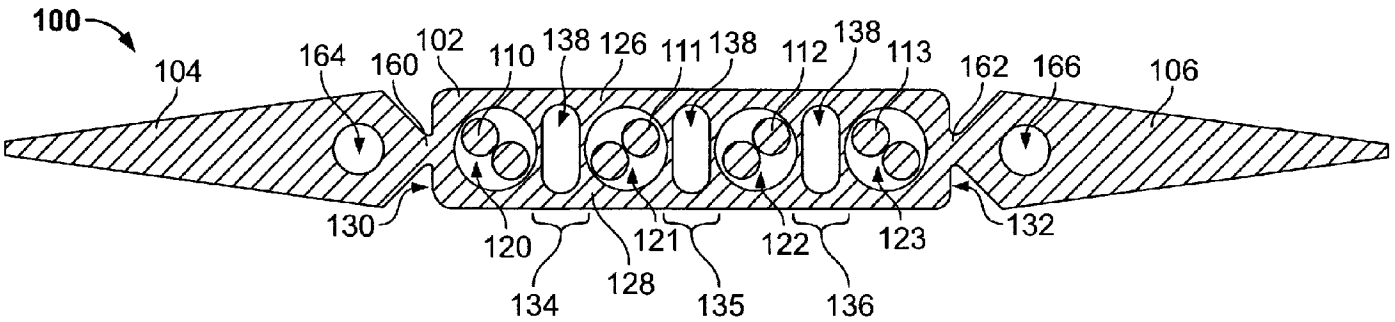
FIG. 2 is a cross-sectional view of the cable shown in FIG 1.

FIG. 2 is a cross-sectional view of the cable 100 taken along the line 2-2 shown in FIG. 1. As shown, the body 102 has a substantially rectangular cross-section and includes an upper portion 126, a lower portion 128, and opposite sidewalls 130 and 132 that join the upper and lower portions 126 and 128. The passages 120-123 may be positioned with respect to each other so that the corresponding twisted pairs of conductors 110-113 maintain a desired electrical performance. In FIG. 1, the passages 120-123 are evenly distributed between the sidewalls 130 and 132 and along a width of the body 102. The passages 120-123 may be aligned with respect to each other such that the passages 120-123 extend along a common plane and in an axial direction (i.e., parallel to the axis 190 shown in FIG. 1). Alternatively, the passages 120-123 may be staggered. For example, the passages 121 and 123 may be proximate to the upper portion 126 and extend along an upper common plane and the passages 120 and 122 may be proximate to the lower portion 128 and extend along a lower common plane.

The body 102 may include a plurality of internal, load-bearing structural sections 134-136 that span between the upper and lower portions 126 and 128 and between adjacent passages. As shown in FIG. 2, the structural section 134 is positioned between adjacent passages 120 and 121, the structural section 135 is positioned between adjacent passages 121 and 122, and the structural section 136 is positioned between adjacent passages 122 and 123. The structural sections 134-136 may be sized and shaped to resist deformation when external forces are induced on the upper and/or lower portions 126, 128. In addition, the structural sections 134-136 may be configured to provide a predetermined spacing S (shown in FIG. 3) between adjacent passages in order to reduce and/or control the electrical coupling or crosstalk between the adjacent electrical conductors.

In one embodiment, each passage 120-123 only holds a single twisted pair of conductors 110-113, respectively. The passages 120-123 may be configured to restrict movement of the single twisted pair of conductors 110-113, respectively. For example, the passages 120-123 may have a cross-sectional shape that tightly surrounds the single twisted pair of conductors thereby restricting movement. As shown in FIG. 2, the cross-sectional shape of the passages 120-123 may be substantially circular, but other shapes, such as a rectangular, triangular, or diamond shape, may be used.

Figure 3:
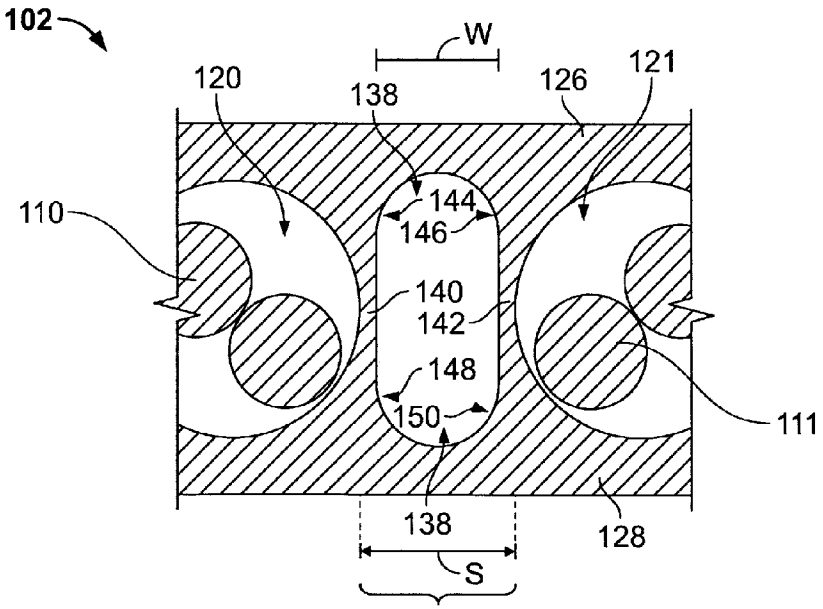
FIG. 3 is an enlarged view of an internal structural section used with the cable shown in FIG 1.

FIG. 3 is an enlarged view of a portion of the cable 100 and illustrates the structural section 134 positioned between adjacent passages 120 and 121. Although the following discussion is directed toward the structural section 134, the description may similarly be applied to the structural sections 135 and 136 and corresponding passages. As shown in FIG. 3, the structural section 134 may include a pocket channel 138 that extends therethrough along a length of the structural section 134. The pocket channel 138 is defined between opposite wall supports 140 and 142 and the upper and lower portions 126 and 128, respectively, and has width W. The pocket channel 138 may provide a gap in the dielectric material between the adjacent passages 120 and 121. In one embodiment, the pocket channel 138 is filled with air. In alternative embodiments, the pocket channel 138 may be filled with a dielectric material that is different from the dielectric material used to form the body 102. The pocket channel 138 alters or changes the effects of the electric and magnetic fields that correspond with the twisted pairs of conductors 110 and 111. The pocket channel 138 may be configured to reduce and/or control the electrical coupling between adjacent twisted pairs of conductors 110 and 111. For example, the width W of the pocket channel may be increased or decreased with respect to the spacing S in order to obtain a desired electrical performance of the cable 100.

Each wall support 140 and 142 may include an upper joint portion 144, 146, respectively, and a lower joint portion 148, 150, respectively. In one embodiment, the joint portions 144 and 148 and joint portions 146 and 150 are configured to resist external forces without substantial deformation of the passages 120 and 121. In other embodiments, the joint portions 144 and 148 of the wall support 140 and the joint portions 146 and 150 of the wall support 142 may be shaped to bend or flex in a predetermined manner when external compressive forces are applied to the upper and/or lower portions 126 and 128. For example, when compressive forces are applied to the body 102 in FIG. 3, the wall supports 140 and 142 may bend or flex into the pocket channel 138. The wall supports 140 and 142 may flex into each other thereby providing further support for the cable 100. Alternatively, the joint portions 144 and 148 and joint portions 146 and 150 may be shaped to flex into the corresponding passages 120 and 121, respectively.

Referring again to FIG. 2, the wing members 104 and 106 project laterally outward from corresponding sidewalls 130 and 132, respectively. The wing member 104 includes a thin connecting portion 160 that joins the wing member 104 to the sidewall 130 and may also be formed from the extruded material that forms the body 102. Likewise, the wing member 106 includes a thin connecting portion 162 that joins the wing member 106 to the sidewall 132. As shown, each wing member 104 and 106 may have a height that is about equal to a height of the body 102 and tapers to a distal end while extending outward. Each wing member 104, 106 may also include a chamber 164, 166, respectively, that extends therethrough along a length of the corresponding wing member. When an external force, such as a foot or wheel, is moving across a width of the cable 100 and pushing into the upper portion 126, the chambers 164 and 166 facilitate transitioning the external force from the wing member 104 and 106 to the body 102.

Figure 4:
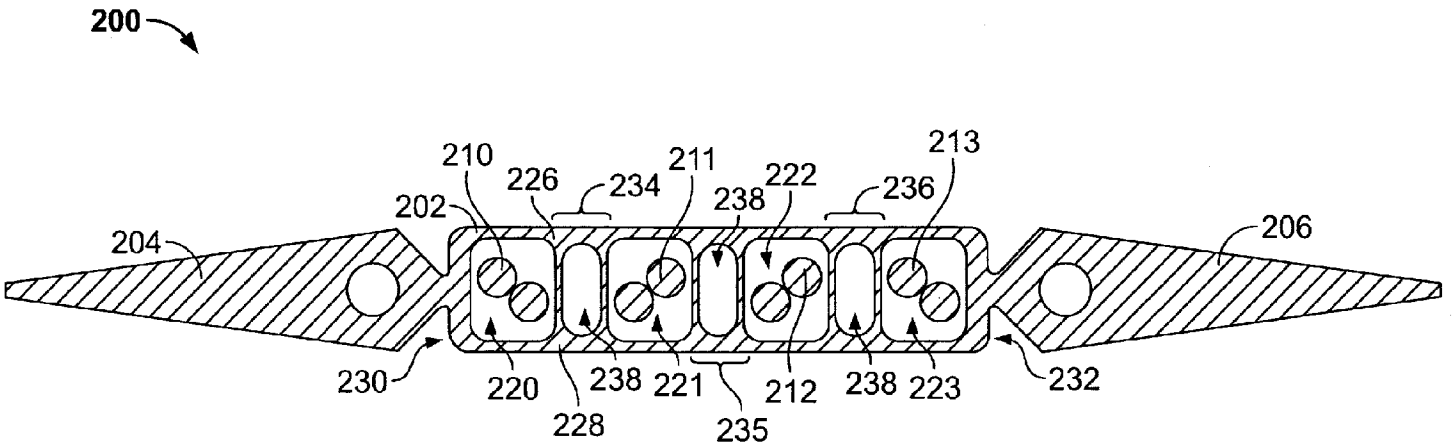
FIG. 4 is a cross-sectional view of a low-profile cable formed in accordance with another embodiment.

FIG. 4 is a cross-sectional view of a low-profile cable 200 formed in accordance with an alternative embodiment. The cable 200 is similarly shaped and includes similar parts as described with reference to the cable 100 (FIGS. 1-3). The cable 200 includes an elongated and substantially rectangular body 202 having an upper portion 226, a lower portion 228, and opposite sidewalls 230 and 232 that join the upper and lower portions 226 and 228. The body 202 also includes a plurality of passages 220-223 that extend axially therethrough a length of the body 202. The passages 220-223 have a substantially square cross-section and are configured to hold a corresponding twisted pair of conductors 210-213, respectively, therein. The square cross-sectional shape of the passages 220-223 may allow more air between the dielectrical material of the body 102 and the corresponding twisted pair of conductors 210-213, respectively, then the substantially circular shape of the passages 120-123 (FIG. 2). Changing the cross-sectional shape of the passages 220-223 alters or changes the effects of the electric and magnetic fields that correspond with the twisted pairs of conductors 210-213. The cross-sectional shape of the passages 220-223 may be configured to reduce and/or control the electrical coupling between adjacent twisted pairs of conductors. In one embodiment, each passage 220-223 has a square cross-sectional shape and is configured to hold only a single twisted pair of conductors 210-213, respectively. Similar to cable 100, the cable 200 may include wing members 204 and 206 that project laterally outward from the body 202.

The body 202 of cable 200 also includes a plurality of internal structural sections 234-236, where each structural section 234-236 separates adjacent passages. The structural section 234-236 may have a pocket channel 238 that extends therethrough a length of the corresponding structural section. Alternatively, the structural section is integrally formed from the dielectric material and does not include a pocket channel 238. Although not illustrated in FIG. 4, the structural sections 234-236 may include opposing wall supports that have joint portions as described with reference to structural sections 134-136 in FIG. 3. Likewise, the joint portions may be configured to flex or bend the wall supports in a predetermined manner when compressive forces are applied to the upper and/or lower portions 226, 228.

Figure 5:
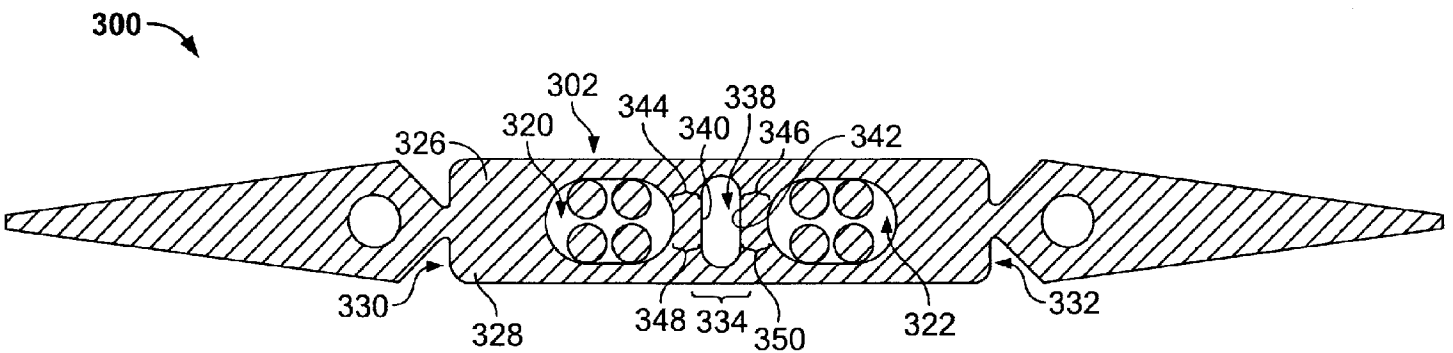
FIG. 5 is a cross-sectional view of a low-profile cable formed in accordance with another embodiment.

FIG. 5 is a cross-sectional view of a low-profile cable 300 formed in accordance with an alternative embodiment. The cable 300 may be similarly shaped and include similar parts as described with reference to the cable 100 (FIGS. 1-3) and the cable 200 (FIG. 4). The cable 300 includes a body 302 having an upper portion 326, a lower portion 328, and opposite sidewalls 330 and 332 that join the upper and lower portions 326 and 328. The body 302 also includes a plurality of passages 320 and 322 that extend axially therethrough a length of the body 302. Cross-sections of the passages 320 and 322 have an elongated oval shape and the passages 320 and 322 are configured to hold two twisted pairs of conductors 310, 311 and 312, 313, respectively, side-by-side therein. The body 302 of cable 300 also includes an internal structural section 334 that separates adjacent passages 320 and 322. The structural section 334 may have a pocket channel 338 that extends therethrough a length of the structural section 334. The pocket channel 338 is similar to the pocket channel 138 described in reference to FIG. 3 and may be configured similarly. The structural sections 334 may include opposing wall supports 340 and 342 that have upper joint portions 344, 346, respectively, and lower joint portions 348, 350, respectively. The joint portions 344 and 348 of the wall support 340 and the joint portions 346 and 350 of the wall support 342 may be configured to flex or bend the wall supports 340 and 342 in a predetermined manner when external forces are applied to the upper and/or lower portions 326, 328. Alternatively, the structural section is integrally formed from the dielectric material and does not include a pocket channel 338.

Figure 6:
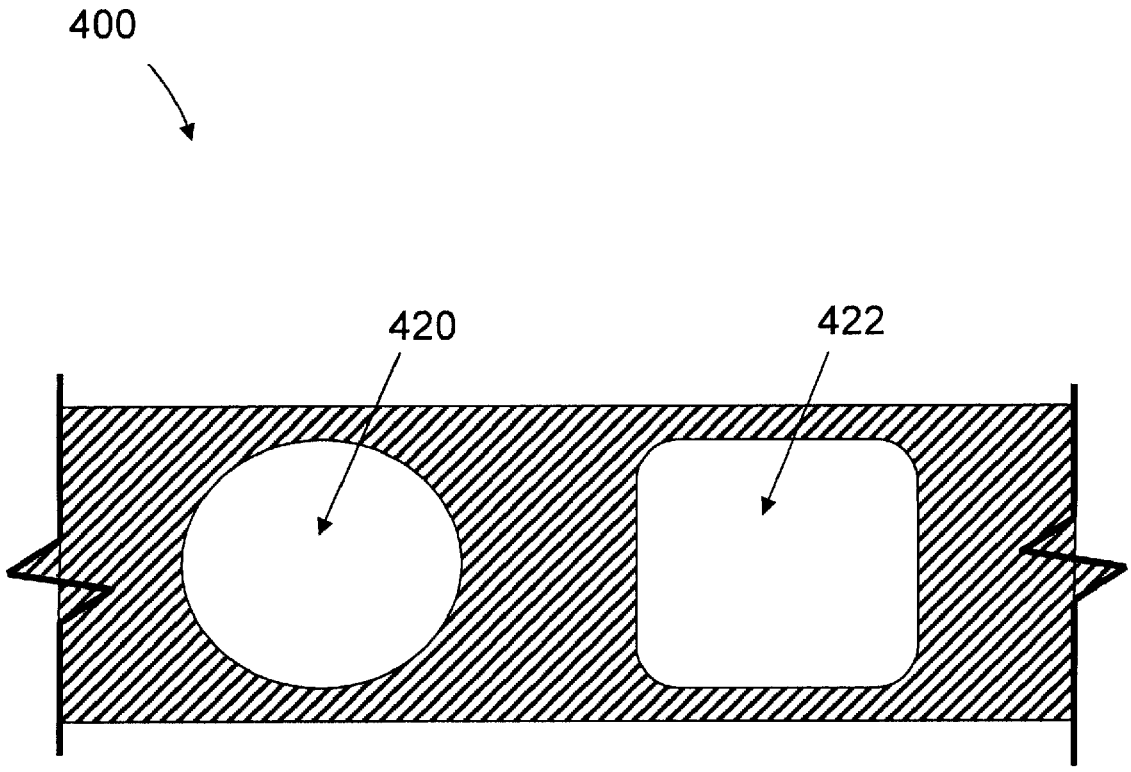
FIG. 6 is a cross-sectional view of a low-profile cable having passages with different cross-sectional shapes.

It is to be understood that the above description is intended to be illustrative, and not restrictive. As such, the above-described embodiments (and/or aspects thereof) may be used in combination with each other. For example, the passages 120-123 or 220-223 may have a variety of shapes within one embodiment of the cable 100. For example, as shown in the cable 400 of FIG. 6, one passage 420 may have a substantially circular shape and the adjacent passage 422 may have a substantially square shape. As another example, in one embodiment, one structural section does not include a pocket channel while another structural section does include a pocket channel. Furthermore, another embodiment may include one passage that is configured to hold only one twisted pair of conductors and another passage that is configured to hold at least two side-by-side twisted pairs of conductors.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments.

Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A low-profile cable comprising:

a body having upper and lower portions extending a length of the body and opposite sidewalls joining the upper and lower portions to one another;

passages located between the sidewalls, the passages extending the length of the body and having a cross-section that is shaped to receive at least one twisted pair of conductors; and a load-bearing structural section spanning between the upper and lower portions, the structural section comprising opposing wall supports separated by a pocket channel therebetween, wherein the structural section is configured to support the upper and lower portions and substantially resist deformation of the passages when external forces are induced onto at least one of the upper and lower portions.

2. The cable in accordance with claim 1 wherein the pocket channel includes an air gap having a width.

3. The cable in accordance with claim 2 wherein two of said passages form a spacing therebetween, the spacing and the width of the air gap being configured to at least one of reduce and control the electrical coupling between said adjacent twisted pairs of conductors in said two passages.

4. The cable in accordance with claim 1 wherein the cross-section of each passage is configured to hold only a single twisted pair of conductors.

5. The cable in accordance with claim 1 wherein the cross-section of each passage is configured to hold at least two twisted pairs of conductors.

6. The cable in accordance with claim 1 wherein each cross-section has a shape and said cross-sections of at least two passages have different shapes.

7. The cable in accordance with claim 1 wherein the wall supports span between the upper and lower portions, the wall supports flexing into one of the pocket channel and a corresponding passage when the external forces are induced onto at least one of the upper and lower portions.

8. The cable in accordance with claim 1 wherein the passages are substantially coplanar.

9. The cable in accordance with claim 1 wherein each wall support of the structural section separates the pocket channel and a corresponding passage, each wall support having an upper joint portion that extends along the upper portion and a lower joint portion that extends along the lower portion, the upper and lower joint portions being shaped to bend or flex the wall support in a predetermined manner into one of the pocket channel and the corresponding passage.

10. The cable in accordance with claim 1 wherein each wall support of the structural section separates the pocket channel and a corresponding passage, the wall supports being shaped to bend or flex into the pocket channel toward each other when external forces are induced onto at least one of the upper and lower portions.

11. The cable in accordance with claim 1 wherein the body has a substantially rectangular cross-section that extends the length of the body.

12. A low-profile cable comprising:

a body having upper and lower portions extending a length of the body and opposite sidewalls joining the upper and lower portions to one another;

passages located between the sidewalls, the passages extending the length of the body and being configured to receive at least one conductor;

a load-bearing structural section spanning between the upper and lower portions, the structural section is configured to support the upper and lower portions and substantially resist deformation of the passages when external forces are induced onto at least one of the upper and lower portions; and at least one wing member projecting outward from a corresponding sidewall and extending along the length of the body, wherein the at least one wing member includes a chamber extending a length of the wing member.

13. A low-profile cable comprising:

a body having upper and lower portions extending a length of the body and opposite sidewalls joining the upper and lower portions to one another;

passages located between the sidewalls, the passages extending the length of the body;

a load-bearing structural section spanning between the upper and lower portions, wherein the passages are configured to receive only a single twisted pair of conductors and the structural section is configured to support the upper and lower portions and substantially resist deformation of the passages when external forces are induced onto at least one of the upper and lower portions; and at least one wing member projecting from a corresponding sidewall and extending along the length of the body, the at least one wing member including a chamber that extends a length of the wing member.

14. The cable in accordance with claim 13 wherein the passages have a cross-sectional shape configured to reduce and/or control the electrical coupling between adjacent twisted pairs of conductors.

15. The cable in accordance with claim 13 wherein the passages form a spacing therebetween, the spacing being configured to reduce and/or control the electrical coupling between adjacent twisted pairs of conductors.

16. The cable in accordance with claim 13 wherein each passage has a shape and at least two of said passages have different shapes.

17. The cable in accordance with claim 13 wherein the structural section comprises opposing wall supports separated by a pocket channel therebetween.

18. The cable in accordance with claim 17 wherein the wall supports flex into one of the pocket channel and a corresponding passage when the external forces are induced onto at least one of the upper and lower portions.

19. The cable in accordance with claim 13 wherein the at least one wing member includes a thin connecting portion that joins the corresponding wing member to the body, the chamber being located proximate to the thin connecting portion.

20. The cable in accordance with claim 13 wherein the chamber of the at least one wing member is positioned within the wing member to facilitate transitioning the external forces from the wing member to the body.

* * * * *